US007196609B2

(12) United States Patent
Wu

(10) Patent No.: US 7,196,609 B2
(45) Date of Patent: Mar. 27, 2007

(54) TRANSFORMER WINDING STRUCTURE

(75) Inventor: Chi-Chih Wu, Taipei County (TW)

(73) Assignee: Taiwan Think-Film Ind. Corp., Taipei County (TW)

( * ) Notice: Subject to any disclaimer, the term of this patent is extended or adjusted under 35 U.S.C. 154(b) by 0 days.

(21) Appl. No.: 11/212,657

(22) Filed: Aug. 29, 2005

(65) Prior Publication Data

US 2006/0164197 A1 Jul. 27, 2006

(30) Foreign Application Priority Data

Jan. 25, 2005 (TW) ..... 94201325 U

(51) Int. Cl.
*H01F 27/30* (2006.01)

(52) U.S. Cl. ..... 336/208; 336/198

(58) Field of Classification Search ..... 336/208
See application file for complete search history.

(56) References Cited

U.S. PATENT DOCUMENTS 4,716,394 A * 12/1987 Gordon ..... 336/192
2002/0145497 A1* 10/2002 Yeh et al. ..... 336/208

FOREIGN PATENT DOCUMENTS

JP 2003092509 A * 3/2003
TW 1227097 B 1/1994

* cited by examiner

*Primary Examiner*—Elvin Enad
*Assistant Examiner*—Joselito S. Baisa
(74) *Attorney, Agent, or Firm*—Birch, Stewart, Kolasch & Birch, LLP

(57) ABSTRACT

A transformer winding structure includes a primary winding rack and at least two secondary winding racks connected with the primary winding rack. The primary winding rack is comprised of a primary winding pipe, and each secondary winding rack is comprised of a secondary winding pipe; wherein the secondary winding pipe is installed horizontally, and the primary winding pipe is installed vertically, so that the thickness of the primary coil winding around the primary winding pipe along the horizontal direction is increased so as to reduce the thickness and volume of the transformer.

14 Claims, 12 Drawing Sheets

| Item | Testing Voltage | Testing Time | Testing Result | Testing Method |
|---|---|---|---|---|
| 1 | 5.0KV | 120sec | OK | LV COIL → HV COIL |
| 2 | 4.9KV | 120sec | OK | LV COIL → CORE |
| | 5.0KV | 6.4sec | NG | |
| 3 | 3.5KV | 120sec | OK | HV COIL → CORE |
| | 3.6KV | 12.1sec | NG | |
| 4 | 4.0KV | 120sec | OK | HV COIL → HV(2)COIL |
| | 4.1KV | 0.2sec | NG | |

Fig. 10A

| Item | Testing Voltage | Testing Time | Testing Result | Testing Method |
|---|---|---|---|---|
| 1 | 3.3KV | 120sec | OK | LV COIL → HV COIL |
| | 3.4KV | 29.2sec | NG | |
| 2 | 2.1KV | 120sec | OK | LV COIL → CORE |
| | 2.2KV | 0.1sec | NG | |
| 3 | 1.8KV | 120sec | OK | HV COIL → CORE |
| | 1.9KV | 4.3sec | NG | |
| 4 | 3.2KV | 120sec | OK | HV(1) → HV(2)COIL |
| | 3.3KV | 40.6sec | NG | |

Fig. 10B

TRANSFORMER WINDING STRUCTURE

FIELD OF THE INVENTION

The present invention relates to a transformer winding structure, and more particularly to an improved transformer winding structure capable of reducing the thickness of the transformer.

BACKGROUND OF THE INVENTION

In a basic structure of a prior art transformer, a winding pipe passes through a core, and the winding pipe is divided into two coil areas: a primary coil area and a secondary coil area, and a primary coil and a secondary coil are wound respectively around the two coil areas, and the primary coil area inputs a voltage, and after the core is excited, the voltage at the secondary coil area is converted and outputted for the use by a load.

For example, a liquid crystal display (LCD) requires a high brightness, and some manufacturers increase the number of lamps for a backlit module in an LCD device, and thus increasing the number of transformers. As a result, not only the size of the LCD device becomes larger, but the weight also becomes heavier. Therefore, some manufacturers design a structure of using a single transformer to drive several lamps in order to solve the foregoing problem. In other words, the demand of using a single transformer to support the application of two or more loads becomes higher.

The prior art transformer that supports the application of two or more loads comprises a primary winding rack and at least two secondary winding racks. The secondary winding racks are aligned side by side with each other and connected with the primary winding rack; the primary winding rack comprises a primary winding pipe, and each secondary winding rack comprises a secondary winding pipe, and the primary winding pipe and the secondary winding pipe are installed horizontally. Further, the primary winding pipe and each secondary winding pipe are wound with a primary coil and a secondary coil respectively, and the primary winding pipe and each secondary winding pipe pass through a core. After the voltage inputted from the primary coil area is excited by the core, the voltage is converted and outputted from each secondary coil area for the use of several loads.

It is worth to note that the prior art primary winding pipe and the secondary winding pipe are installed horizontally, so that if the load power is increased (or the number of connected loads is increased), the primary coil of the primary winding pipe results in a significant rise of temperature, and thus creating an overheat problem to the transformer. Although the diameter of the wire of the primary coil can be increased to solve the overheat problem, the thickness of the primary coil winding around the primary winding pipe will be increased in the vertical direction, since the primary winding pipe is installed horizontally. As a result, the thickness of the transformer will be increased, and the volume of the transformer cannot be reduced.

Referring to FIGS. 7 and 8 for the prior art inverter and a discharge lamp light up circuit using the inverter (as disclosed in R.O.C. Patent Publication No. I227097), one inverter is used to obtain a plurality of outputs. A pair of magnetic cores 700 are combined into a closed magnetic path, and a primary coil 800 and a plurality of secondary coils 810 are wound around the magnetic core 700 in any one direction, and then the primary coil 800 and a plurality of secondary coils 810 are wound horizontally on the same plane, so that the primary coil 800 and the secondary coil 810 are wound vertically. Referring to FIG. 9, the two secondary coils 810 are wound in the opposite direction to prevent an electric discharge produced between the magnetic core 700 and the wiring pattern. However, the secondary coil 810 is wound in the same winding and is not isolated by any partition design, and thus it is very easy to come up with a deviated winding by machine, and the potential resisting effect of the inverter is not as good.

SUMMARY OF THE INVENTION

Therefore, it is a primary objective of the present invention to provide an improved transformer winding structure capable of reducing the thickness and the volume of a transformer.

To achieve the foregoing objective, the present invention provides an improved transformer winding structure that comprises a primary winding rack and at least two secondary winding racks connected to the primary winding rack. The primary winding rack comprises a primary winding pipe and each secondary winding rack comprises a secondary winding pipe; wherein the secondary winding pipe is installed along the horizontal direction and the primary winding pipe is installed along the vertical direction. Since the primary winding pipe is installed vertically, therefore the thickness of the primary winding pipe wound by the primary coil will be increased along the horizontal direction, and thus can reduce the thickness and the volume of the transformer.

The foregoing, as well as additional objects, features and advantages of the invention will be more readily apparent from the following detailed description, which proceeds with reference to the accompanying drawings.

BRIEF DESCRIPTION OF THE DRAWINGS

FIGS. 10A and 10B are comparison tables of a high potential test result of a transformer between the present invention and the prior art;

DETAILED DESCRIPTION OF THE PREFERRED EMBODIMENTS

Figure 1:
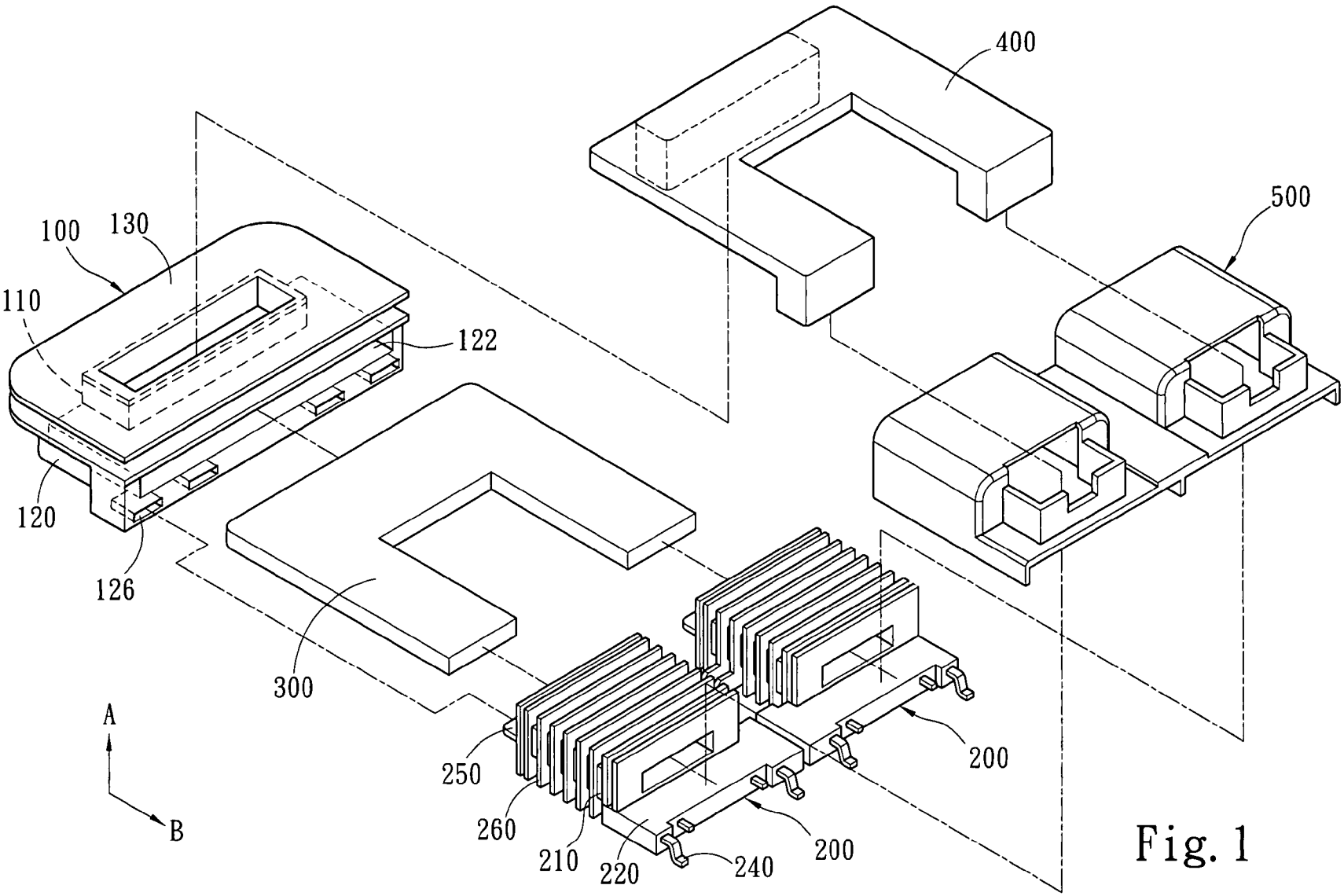
FIG. 1 is an exploded view of a transformer winding structure according to a preferred embodiment of the present invention.
Figure 2:
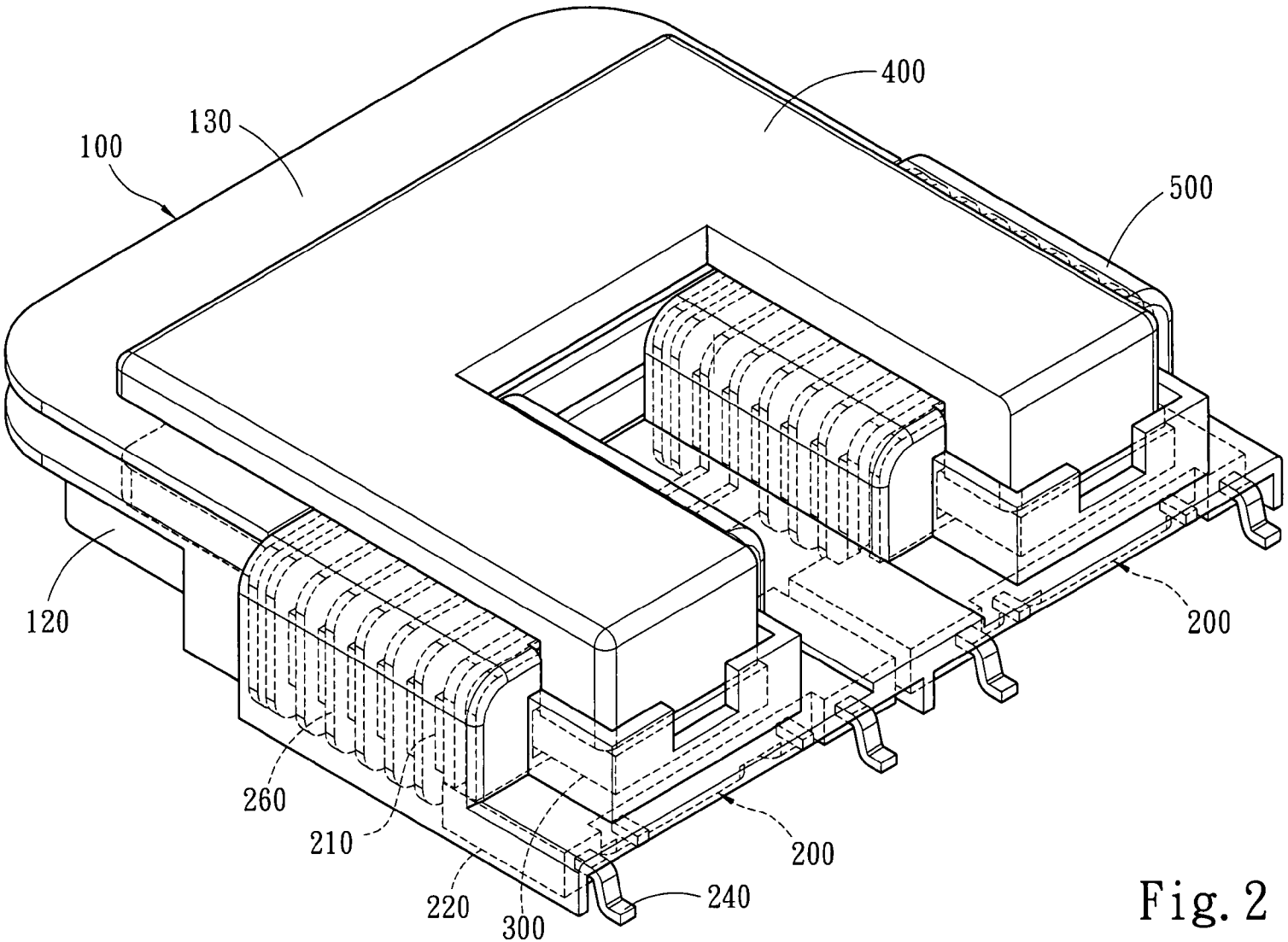
FIG. 2 is a perspective view of a transformer winding structure according to a preferred embodiment of the present invention.
Figure 3:
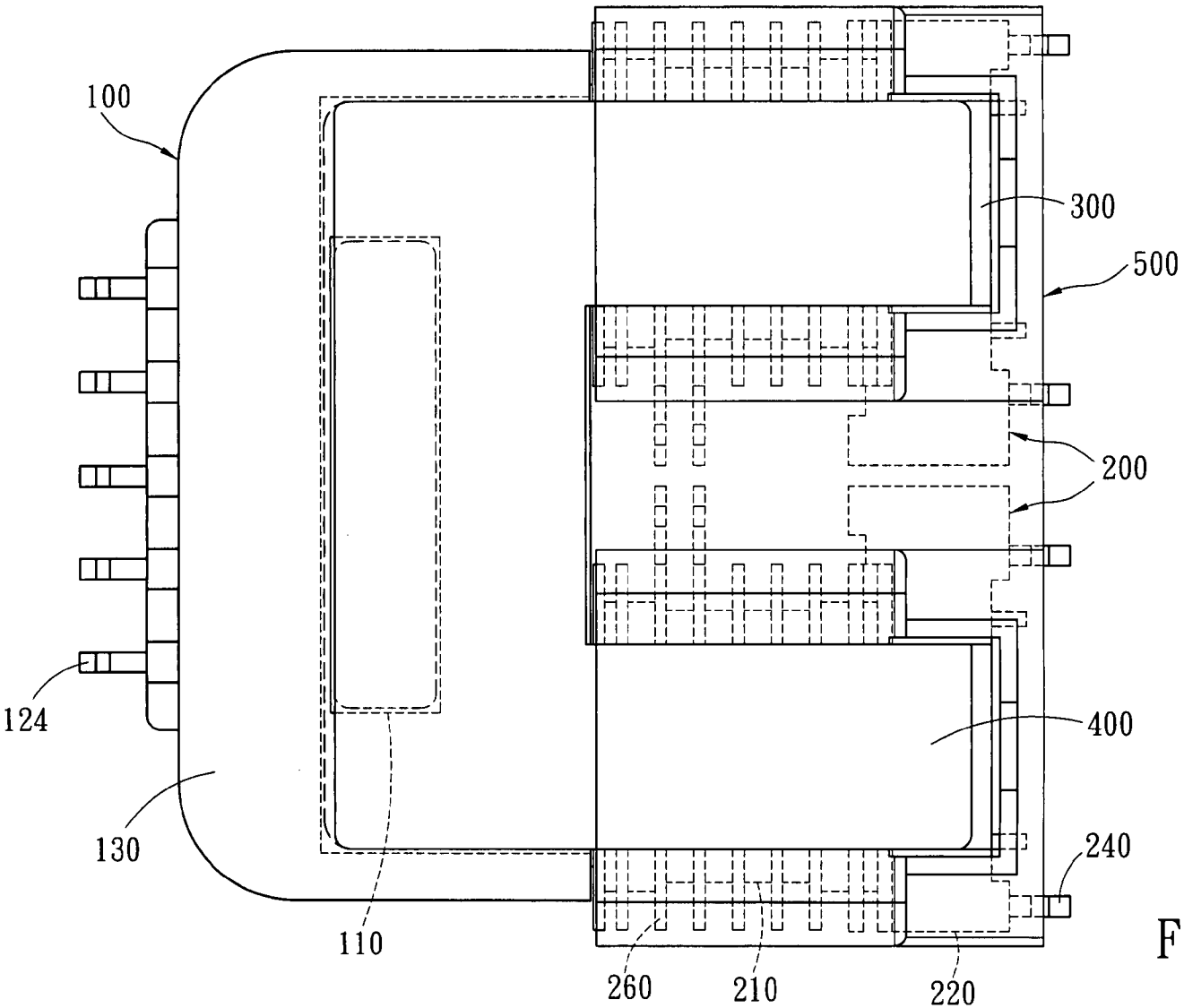
FIG. 3 is a bottom view of a transformer winding structure according to a preferred embodiment of the present invention.

Refer to FIGS. 1 to 4 for the transformer winding structure according to a preferred embodiment of the present invention, the transformer winding structure comprises a primary winding rack 100 and two secondary winding racks 200. The primary winding rack 100 comprises a rectangular primary winding pipe 110 and a rectangular installing section 120; wherein the primary winding pipe 110 is installed on the installing section 120 along the vertical direction A, and one end of the primary winding pipe 110 is connected to the top of the rectangular installing section 120 and the other end is connected to a partition section, and the primary winding pipe 110 is provided for wounding the primary coil 140.

In addition, the installing section 120 includes a core installing groove 122 disposed on a side of the installing section 120 and interconnected with the primary winding pipe 110. The installing section 120 also includes a plurality of first terminals 124 disposed on the opposite side of the core installing groove 122 for connecting the primary coil 140 and inputting a voltage.

Each secondary winding rack 200 comprises a rectangular secondary winding pipe 210 and an installing section 220 connected to a side of the secondary winding pipe 210; wherein the secondary winding pipe 210 is provided for winding the secondary coil 230, and the installing section 220 includes a plurality of second terminals 240 for connecting the secondary coil 230 and soldering it onto a circuit board (not shown in the figure) for outputting a converted voltage. Further, a latch protrusion 250 is extended from another side of the secondary winding pipe 210 and sheathed into the latch groove 126 of the rectangular installing section 120 on the same side of the core installing groove 122, so that the secondary winding pipe 210 of each secondary winding rack 200 can be connected with the primary winding rack 100 along the horizontal direction B. Further, the secondary winding pipe 210 includes a plurality of partition sections 260 for dividing the secondary winding pipe 210 into a plurality of wire winding areas, so as to prevent an arcing caused by an excessively high potential difference between layers when several layers of secondary coil 230 are wound around the secondary winding pipe 210.

A U-shape core 300 passes through the core installing groove 122 and two secondary winding pipes 210 of the foregoing installing section 120, and the primary winding rack 100 and two secondary winding racks 200 install another U-shape core 400; wherein an end of the U-shape core 400 is extended downward and passed through the primary winding pipe 110, and the other end of the U-shape core 400 is extended downward and passes together with the U-shape core 300 through the partial contact of the secondary winding pipe 210 to define a close magnetic area. Therefore, the voltage inputted from the primary coil area is excited by the U-shape cores 300, 400, and then the voltage of each secondary coil area is converted and outputted for the uses of a plurality of rear-end loads.

Further, before the foregoing U-shape core 400 is installed, a protective cover 500 can be installed for covering the two secondary winding racks 200, and the protective cover 500 exposed some areas of the U-shape core 300, such that the U-shape core 400 can be in contact with the U-shape core 300. With the design of the protective cover 500, the structural strength can be enhanced to prevent the electric properties of the secondary winding rack 200 from being affected by the collision of external forces.

Figure 4:
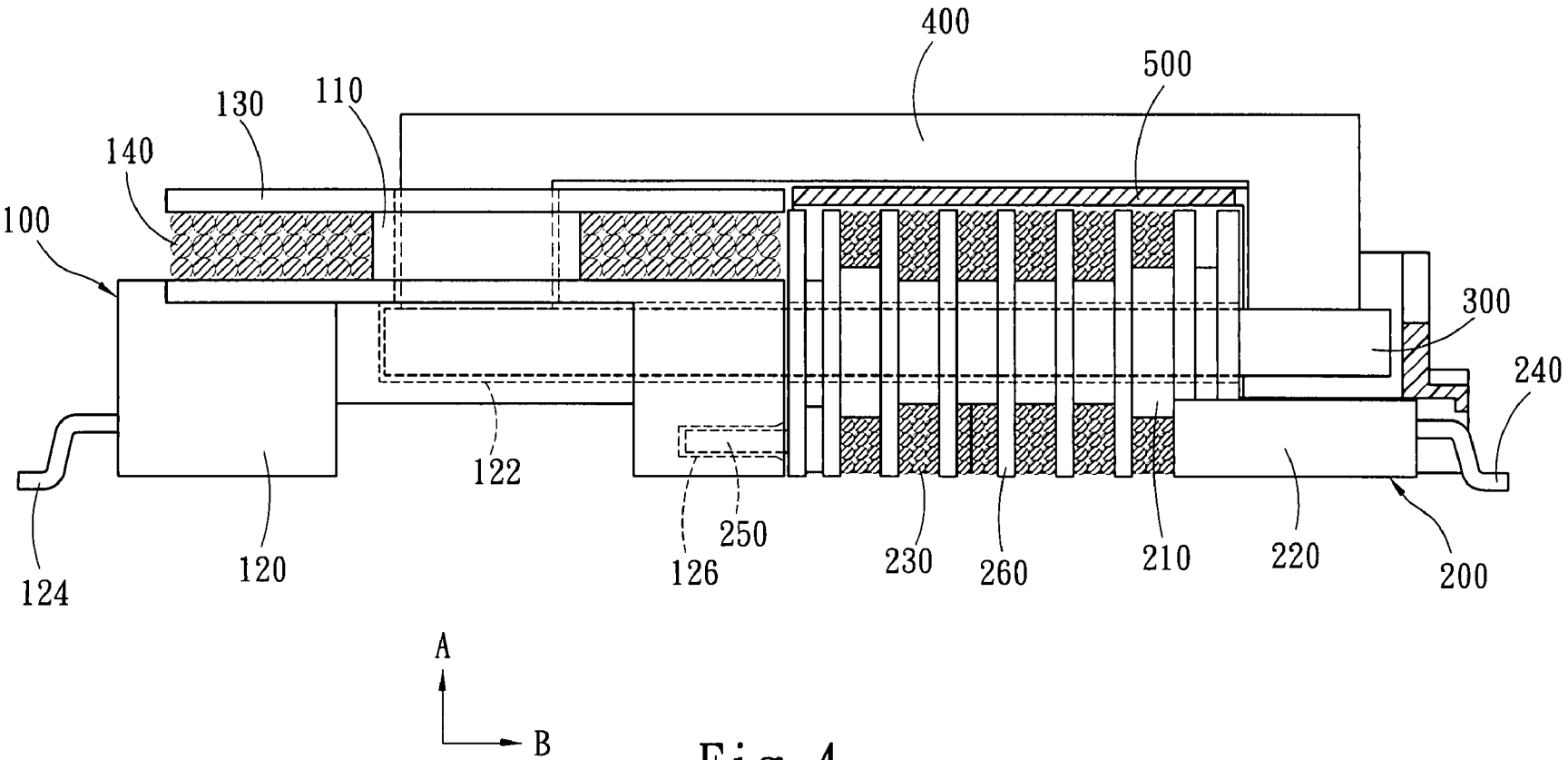
FIG. 4 is a side view of a transformer winding structure according to a preferred embodiment of the present invention.

Referring to FIG. 4, it is worth to point out that the primary winding pipe 110 of this preferred embodiment is installed along the vertical direction A, therefore the primary coil 140 is installed along the horizontal direction B and wound around the primary winding pipe 110. If the load power is increased (or more loads are connected), then the primary coil 140 requires a thicker wire to solve the overheat problem. In the set wire winding area (depending on the height of the primary winding pipe 110), the thickness of the primary coil 140 wound around the primary winding pipe 110 along the horizontal direction B is increased. Therefore, the thickness of the transformer will not be increased, but the volume of the transformer can be reduced.

Figure 5:
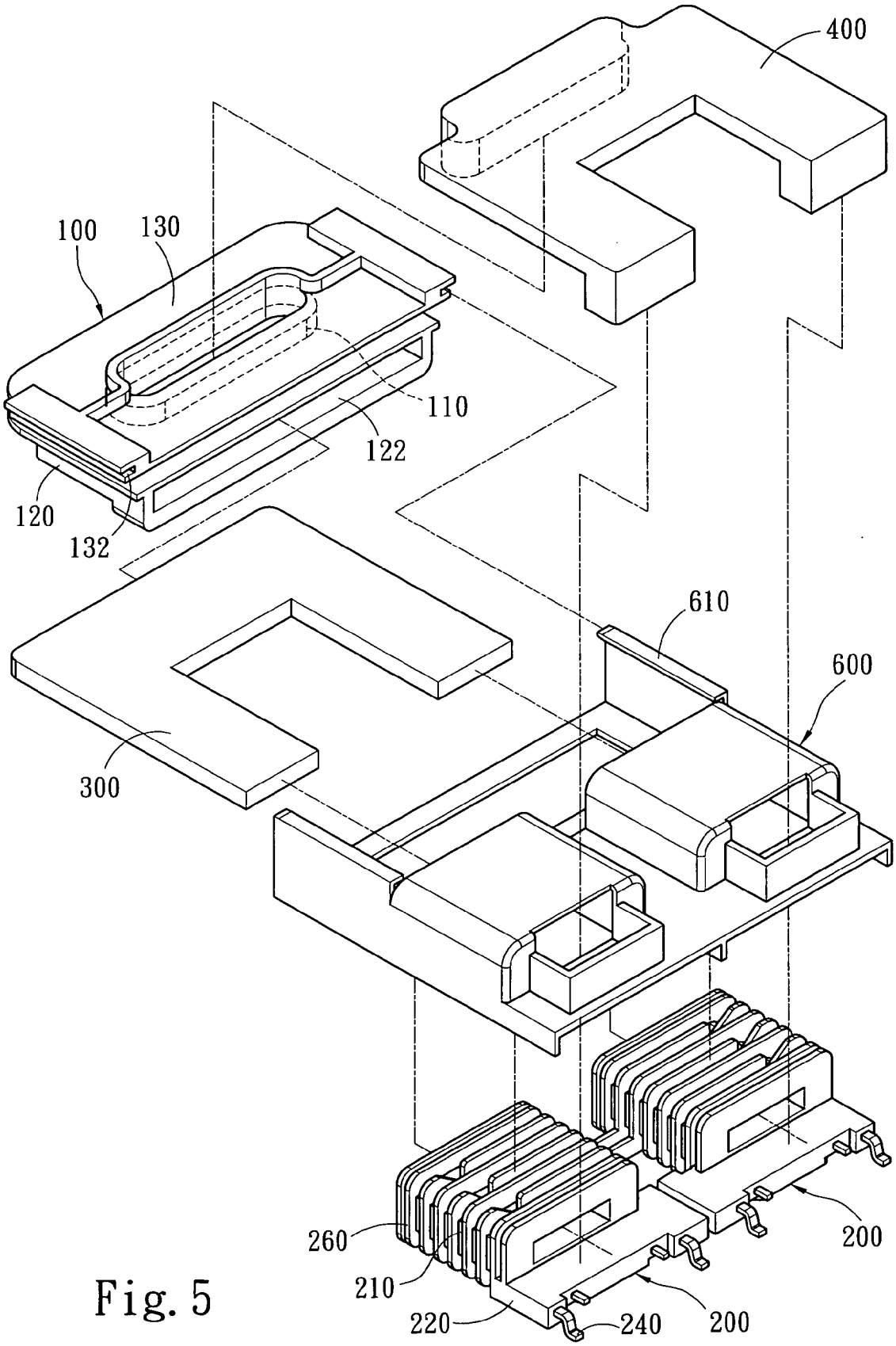
FIG. 5 is an exploded view of a transformer winding structure according to another preferred embodiment of the present invention.
Figure 6:
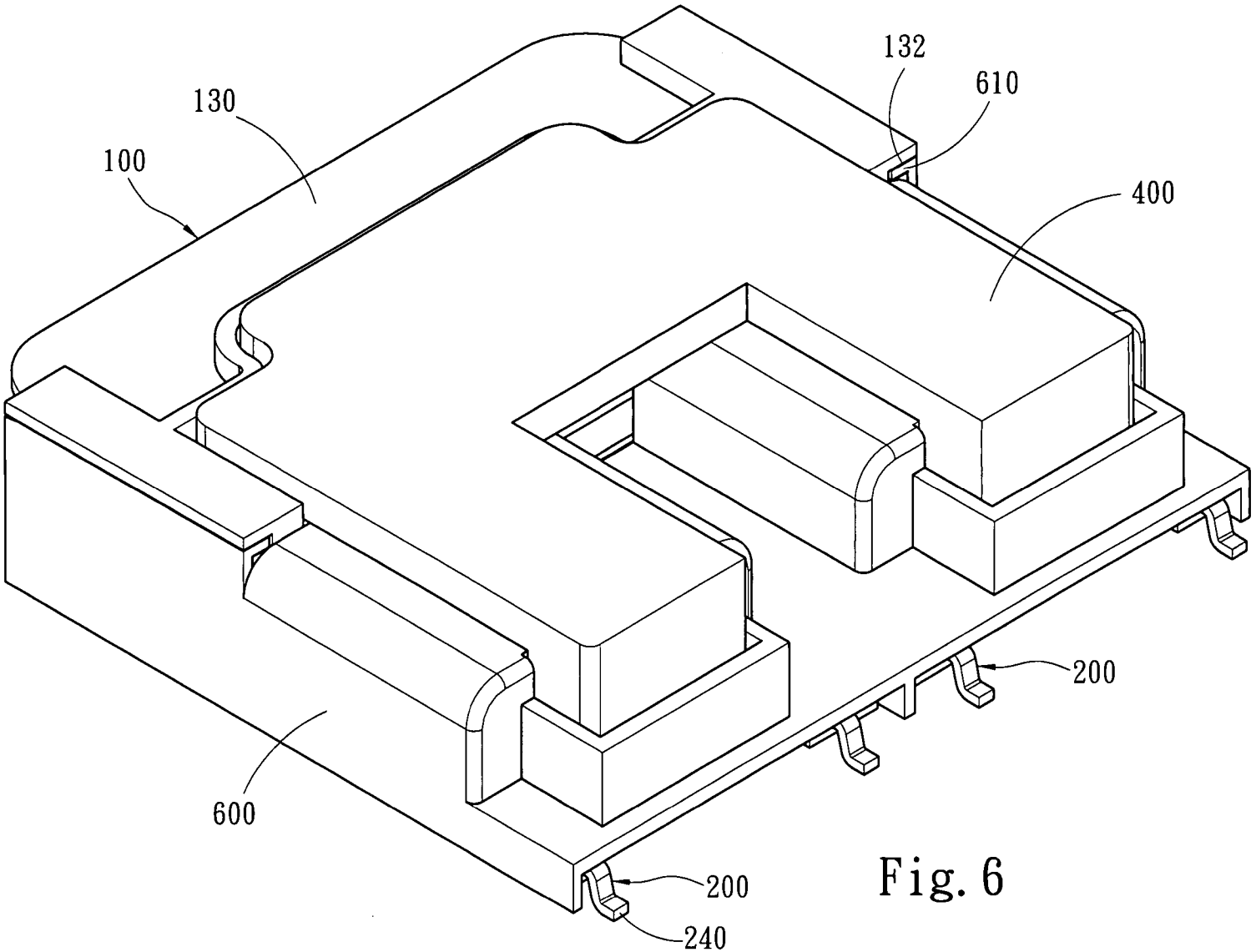
FIG. 6 is a perspective view of a transformer winding structure according to another preferred embodiment of the present invention.
Figure 7:
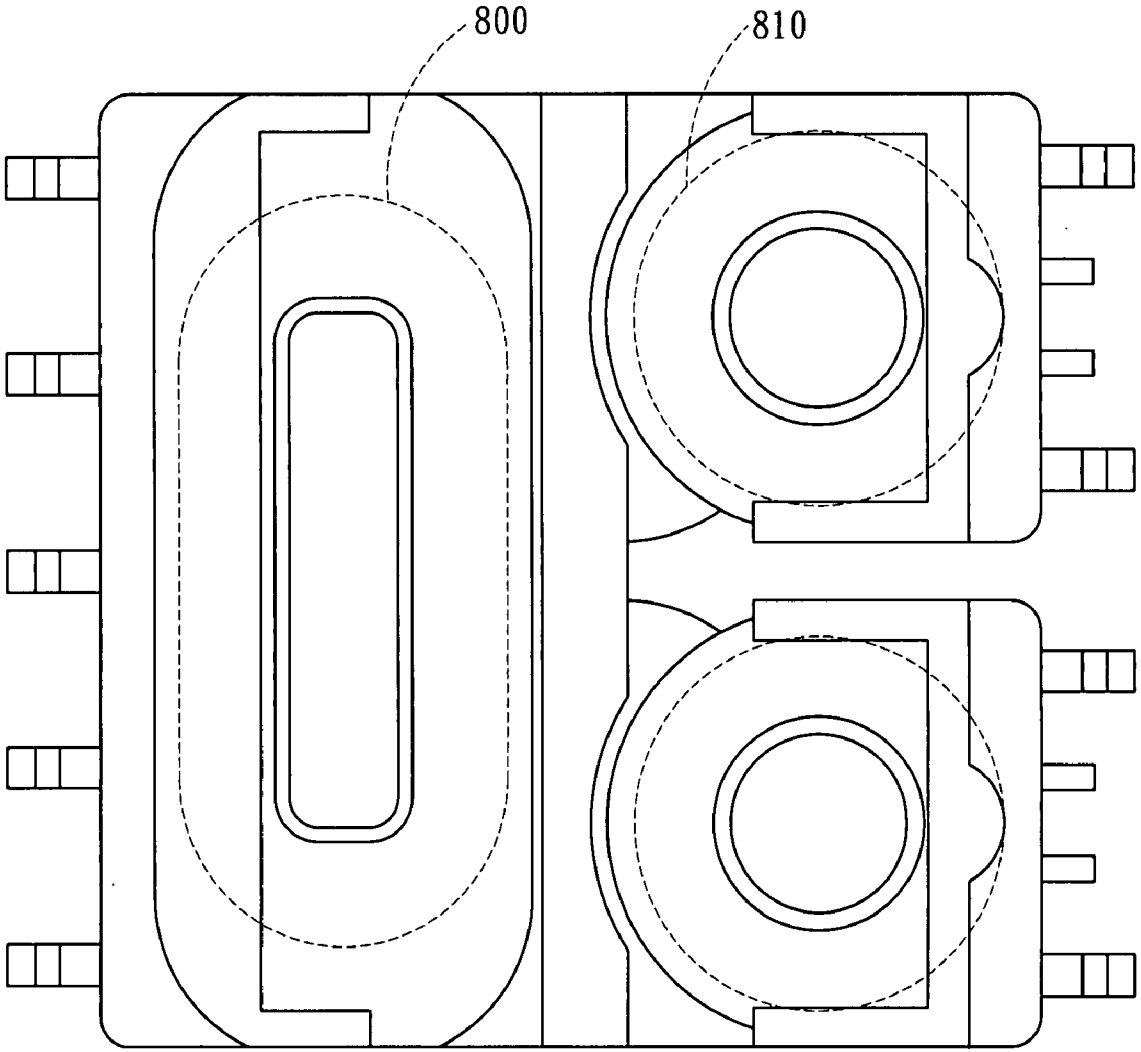
Fig. 7 PRIOR ART
FIG. 7 is a planar view of a prior art inverter.
Figure 8:
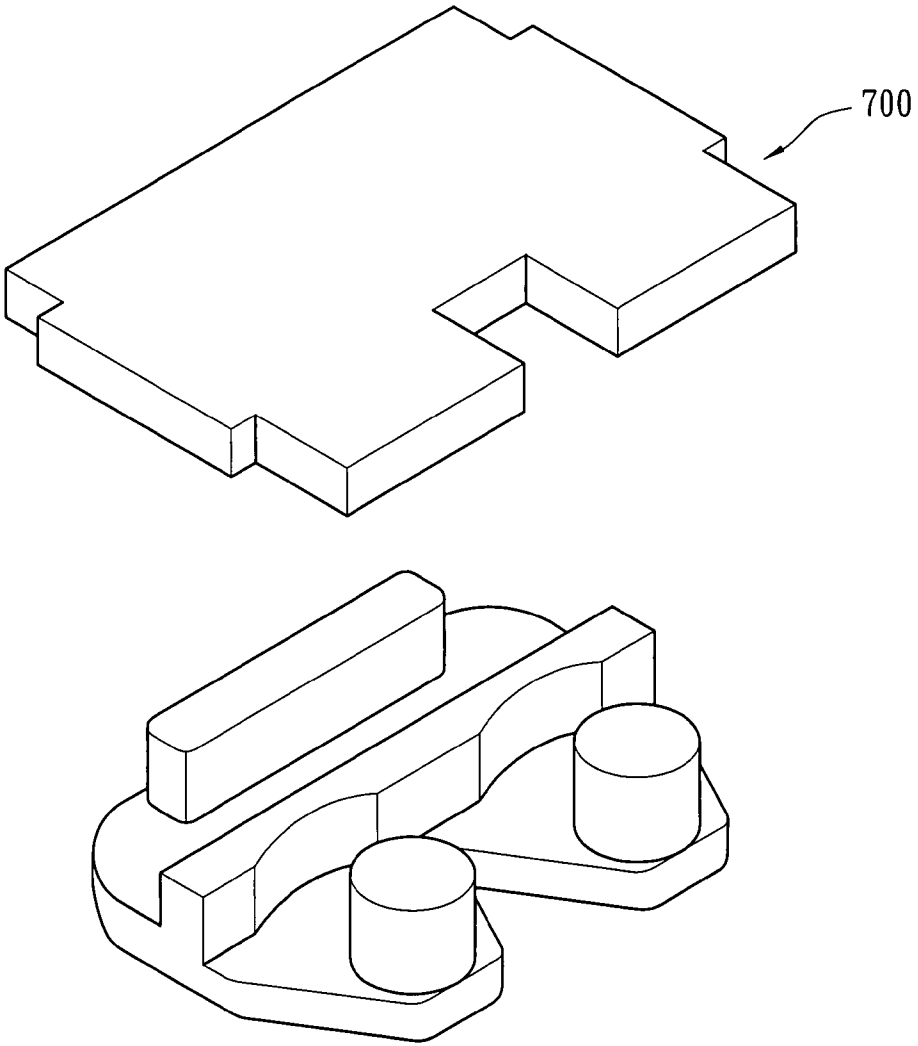
Fig. 8 PRIOR ART
FIG. 8 is a cross-sectional view of a prior art inverter.
Figure 9:
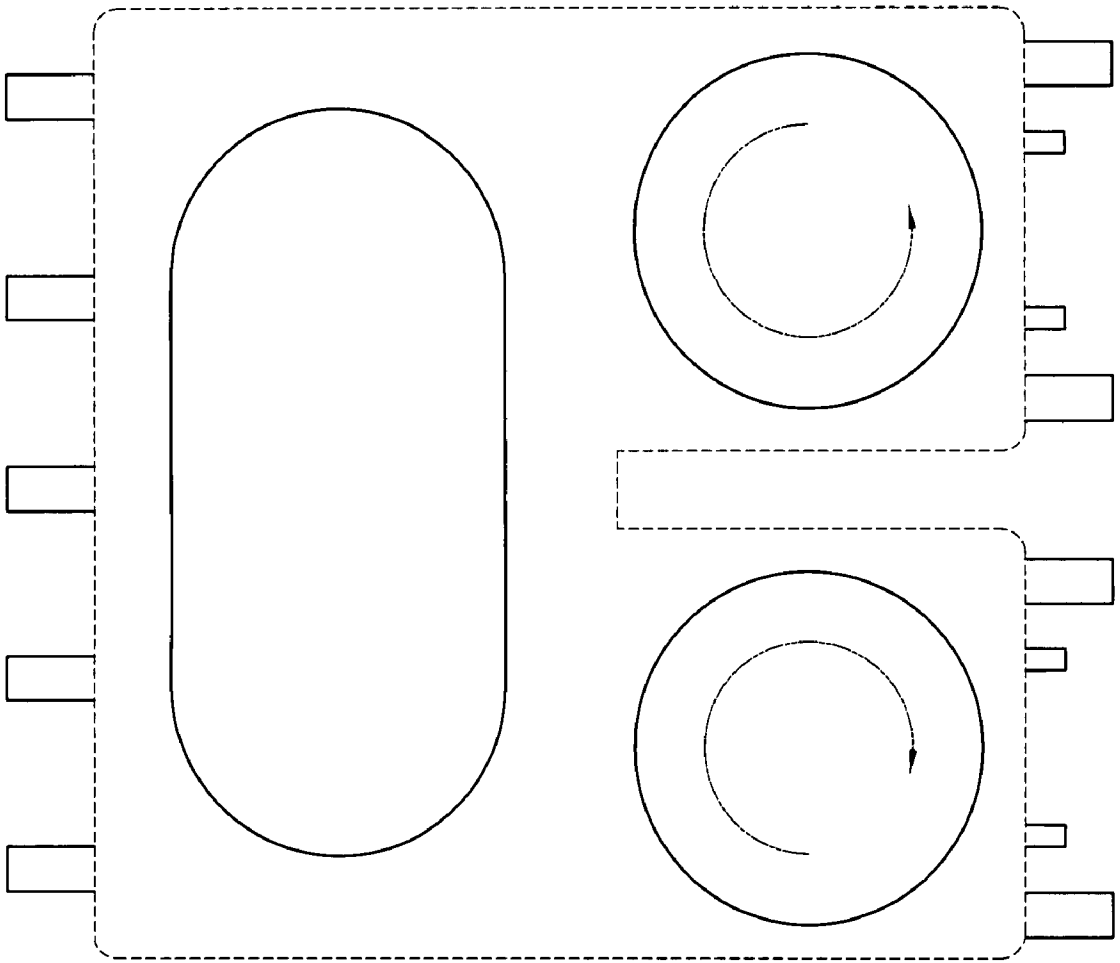
Fig. 9 PRIOR ART
FIG. 9 is a simplified planar view of a prior art inverter.

Referring to FIGS. 5 and 6 for another preferred embodiment of the present invention, the main structure of this preferred embodiment is substantially the same as the foregoing preferred embodiment and the same elements are labeled with the same numerals, and will not be described here. The difference of these two preferred embodiments resides on that a pair of sliding grooves 132 are installed on both sides parallel to the installing direction of the partition section 130 and the secondary winding pipe 210. Before the foregoing U-shape core 400 is installed, a protective cover 600 covers the primary winding rack 100 and two secondary winding racks 200, and the protective cover 600 includes a pair of sliding tracks 610 disposed on both sides of the pair of the sliding grooves 132 corresponding to the partition section 130. Before the installation, two secondary winding racks 200 are placed into the protective cover 600. After the U-shape core 300 is installed, the two secondary winding racks 200 are embedded into the sliding grooves 132 of the partition section 130 for the positioning through the sliding track 610 of the protective cover 600, and the protective cover 600 also will expose some areas of the U-shape core 300, such that the U-shape core 400 can be in contact with the U-shape core 300. With the design of the protective cover 600, the structural strength can be enhanced to prevent the electric properties of the primary winding rack 100 and secondary winding rack 200 from being affected by the collisions of external forces. Further, the sliding track 610 of the protective cover 600 is embedded into the sliding groove 132 of the partition section 130 to indirectly connect the primary winding rack 100 with the secondary winding rack 200, so as to save the latch groove 126 and the latch protrusion 250 as described in the foregoing preferred embodiment.

In summation of the description above, the improved transformer winding structure of the present invention installs the primary winding pipe 110 along the vertical direction A to increase the thickness of the primary coil 140 wound around the primary winding pipe 110 along the horizontal direction B, so as to reduce the thickness and the volume of the transformer.

To make it easier for our examiner to understand the technical characteristics of the invention, the performance of the technical functions of the present invention and the prior art (as disclosed in R.O.C. Patent Publication No. I227097) is tested and the comparisons of three test reports including a high potential test report, a dynamic potential resisting test report, and a layer potential resisting test report are given as follows:

(1) High Potential Test:

Testing Conditions:
(1) Electric Leakage Setting: 3 mA
(2) Testing Voltage: AC 3 KV (min)
(3) Frequency: 60 HZ Referring to FIGS. 10A and 10B for the high potential test (HI-POT Test) reports of the transformers of the present invention and the prior art, the data show that each winding pipe of the transformer of the present invention can resist a voltage over 3 KV, because the wire is wound around the external diameter of the primary winding pipe 110 of the transformer winding structure and installed along the vertical direction A and the secondary winding pipe 210 is installed along the horizontal direction B. Since the transformer winding structure is not installed on the same plane, therefore the safety distance between the primary winding pipe 110 and the secondary winding pipe 210 is increased, and a higher voltage will be induced and produced to increase the safety coefficient of the transformer. Compared with the prior art, the primary coil and a plurality of secondary coils of the prior art are arranged transversally on the same plane, and the present invention can bear a higher voltage difference than the prior art. Therefore, the present invention can effectively extend the longevity of the transformer, and also can be used in the electric appliances with a super high voltage.

(2) Dynamic Potential Resisting Test

Testing Conditions:
(1) Primary Winding Number: 14 T: Secondary Winding Number 1650T
(2) GAP: 0.075 mm
(3) Frequency: 100 KHZ
(4) Cycle: 50
(5) Testing Voltage: 3 KVrms
(6) Testing Terminals CH1, CH2 are separately connected to the two output terminals of the two secondary coils.

Test Results:

The transformer of the present invention produces an arcing in 2 minutes 29 seconds.

The prior art transformer produces an arcing in 67 seconds.

Figure 11A:
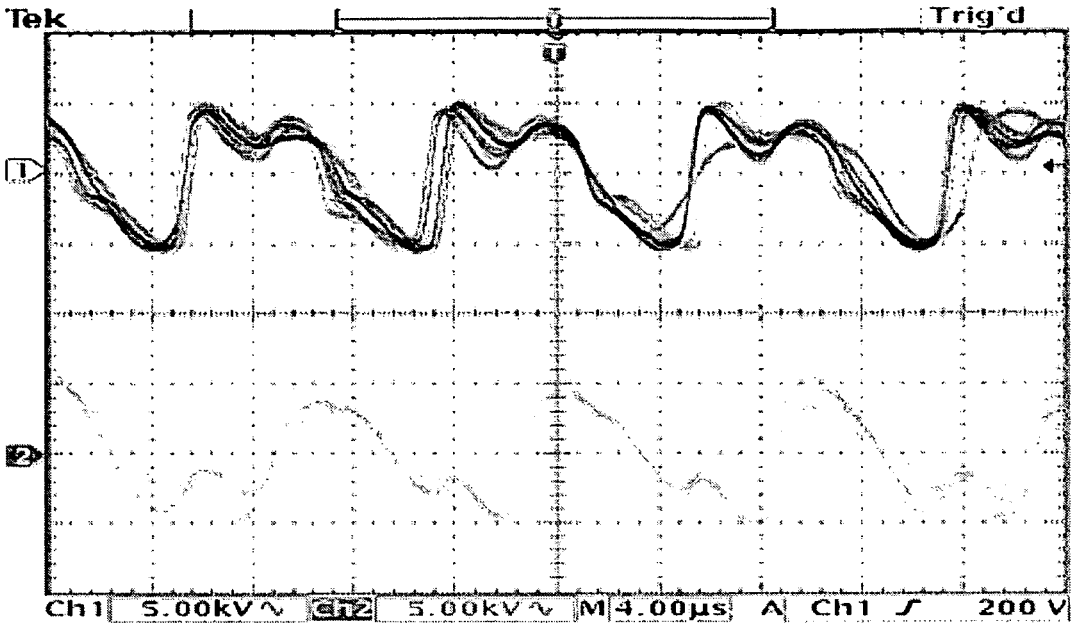
FIGS. 11A and 11B are the comparisons of the waveforms and the numeric charts of the dynamic potential resisting test results of the transformers between the present invention and the prior art.
Figure 11B:
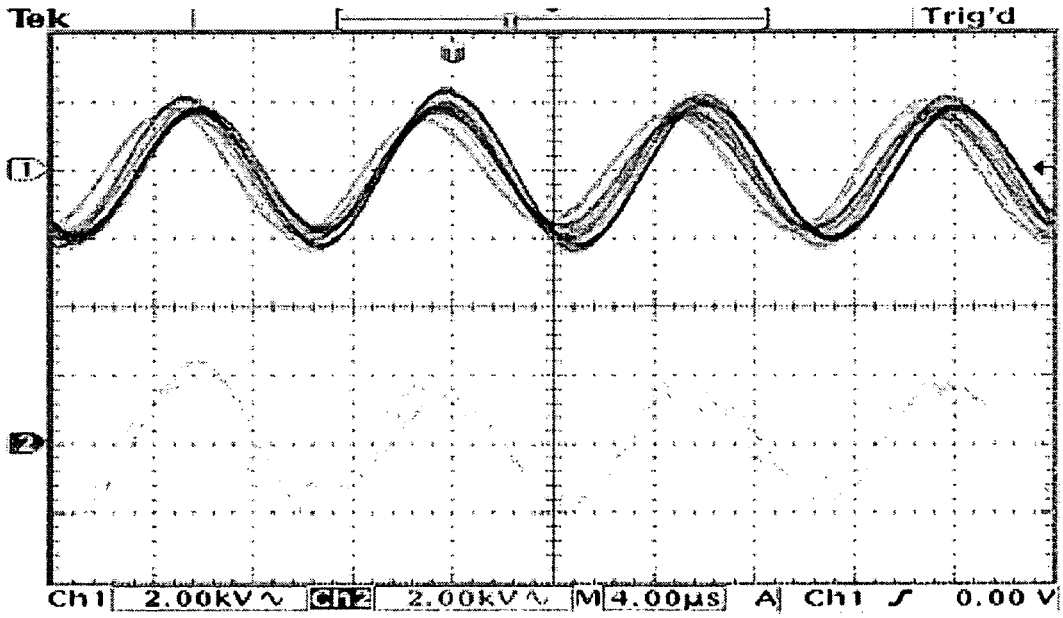

Referring to FIGS. 11A and 11B for the dynamic voltage resisting test reports of the transformers of the present invention and the prior art, it is known that the secondary winding pipe 210 of the transformer winding structure of the present invention includes a plurality of partition sections 130, and two secondary winding pipes 210 are installed separately, and thus the secondary coil 230 is wound and partitioned separately to increase the safety distance of the winding, and the transformer winding structure can bear a higher voltage, so as to prevent any arcing caused by sparks and an excessively large voltage difference between the partitions of the secondary winding pipe 210. Compared with the prior art, the prior art coils a plurality of secondary coils without any partition in the coil, and thus the present invention can provide a longer voltage resisting time and thus effectively extending the longevity of the transformer.

(3) Layer Potential Resisting Test

Testing Conditions:
(1) Area Difference Ratio: Set Value: 3.0%
(2) Trace Electric Discharge: Set Value: 10
(3) Testing Voltage: 8 KV Test Results:

The testing value of the area difference ratio of the transformer is 1.0%, and the testing value of the trace discharge is 7, which has not exceeded the standard setting of 10. The test result is determined as OK.

The testing value of the area difference ratio of the prior art transformer is 2.0%, and the testing value of the trace discharge is 23, which exceeds the standard setting of 10. The test result is determined as NG (producing a larger discharge).

Figure 12A:
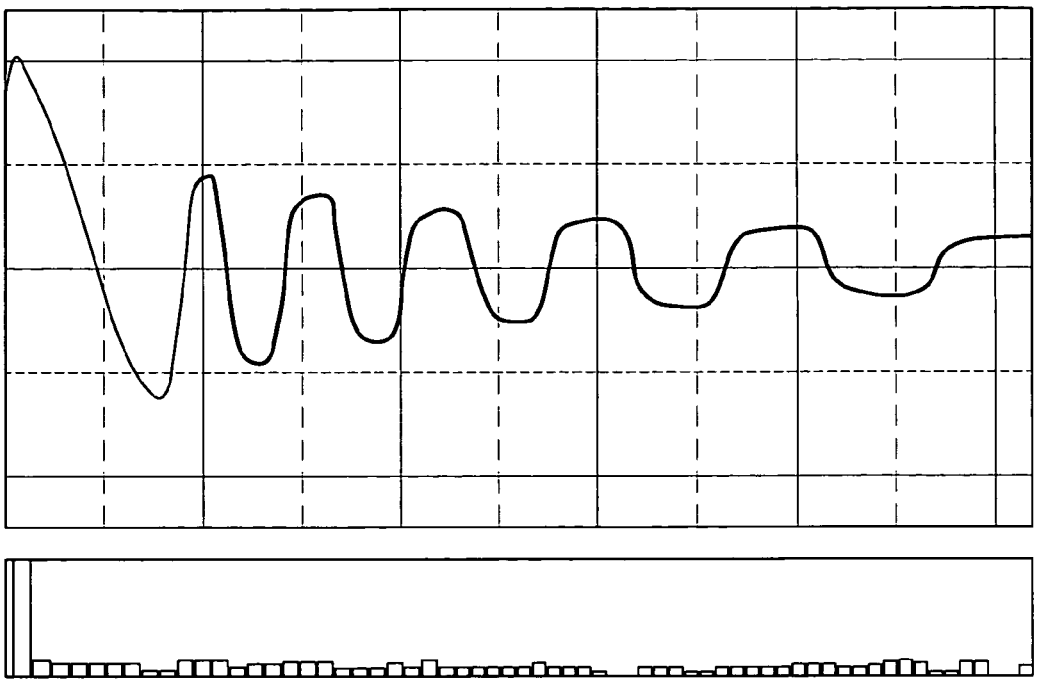
FIGS. 12A and 12B are schematic views of the comparisons of changes of the potential resisting test results for the layers of the transformers between the present invention and the prior art.
Figure 12B:
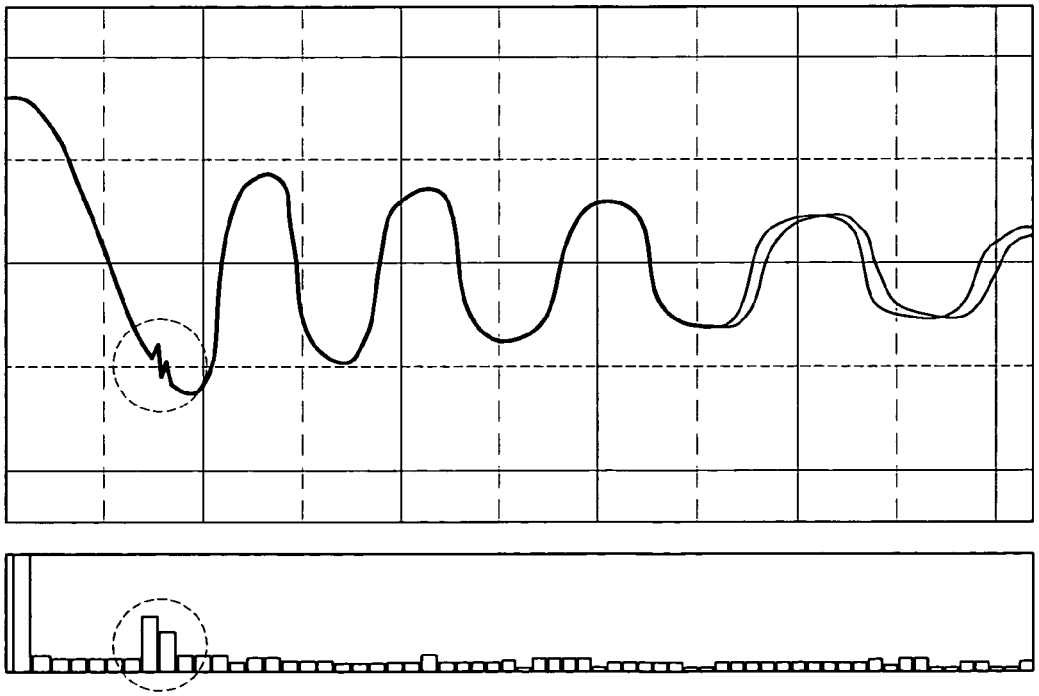

Referring to FIGS. 12A and 12B for the layer voltage resisting test reports of the transformer between the present invention and the prior art, it is known that the primary winding rack 100 and the secondary winding rack 200 of the transformer winding structure of the present invention are insulated, and each partition section 130 separately arranged in the secondary winding pipe 210 is made of an insulating material, and thus the secondary coil 230 is wound and partitioned separately to prevent the interference between the transformer winding structures when the voltage difference is too large and there is a trace discharge. From the bar chart of FIG. 12A, the signal of the bar chart is very stable, indicating that when a high voltage is inputted into the transformer of the present invention, there is a lower chance to have a trace discharge or interference. If the testing voltage is increased to 10 KV, the present invention can achieve the layer voltage resisting effect, and provide a higher safety coefficient. On the other hand, the selected position (produced by the testing voltage of 8 KV) of the prior art transformer as shown in the bar chart of FIG. 12B is obviously higher than other positions. The measured testing value of the trace discharge is about 23, which has exceeded the standard of the trace discharge (standard setting is about 10). Referring to the waveform corresponding to the selected position in the bar chart, the waveform is not stable since the trace discharge has exceeded the standard.

While the invention has been described by means of specific embodiments, numerous modifications and variations could be made thereto by those skilled in the art without departing from the scope and spirit of the invention set forth in the claims.

What is claimed is:

1. A transformer winding structure, comprising a primary winding rack and at least two secondary winding racks coupled to said primary winding rack, said primary winding rack has a primary winding pipe, and said each secondary winding rack has a secondary winding pipe, and said secondary winding pipe is disposed along a horizontal direction, said primary winding pipe is disposed along a vertical direction, such that said primary coil is wound to increase the thickness of said primary winding pipe along the horizontal direction, so as to reduce the thickness of said transformer and to form an outside perimeter of the primary coil, the secondary winding racks being to a side of the primary winding rack such that the secondary winding racks are outside the perimeter of the primary coil.

2. The transformer winding structure of claim 1, wherein said primary winding rack further comprises an installing section, and said installing section includes a core installing groove on a side and an end of said primary winding pipe is coupled to the top of said installing section and interconnected with said core installing groove.

3. The transformer winding structure of claim 2, wherein said primary winding pipe further includes a partition section disposed on the other end of said primary winding pipe.

4. The transformer winding structure of claim 3, wherein said partition section and said secondary winding pipe comprise a pair of sliding grooves disposed along both sides parallel to the installing direction of said partition section and said secondary winding pipe, and said transformer winding structure further comprises a protective cover for covering said primary winding rack and said secondary winding racks, and said protective cover includes a pair of sliding tracks disposed on both sides of said sliding groove corresponding to said partition section for being embedded into said sliding groove and said protective cover enhances the structural strength.

5. The transformer winding structure of claim 2, wherein said installing section disposed on the opposite side of said core installing groove comprises a plurality of first terminals for inputting a voltage.

6. The transformer winding structure of claim 2, wherein said installing section disposed on the same side of said core installing groove comprises at least one latch groove, said each secondary winding pipe comprises a plurality of latch protrusions extended from one side of said secondary winding pipe, which has a quantity equal to that of said latch grooves and coupled to said latch grooves.

7. The transformer winding structure of claim 6, further comprising a protective cover for covering said secondary winding racks, and said protective cover capable of enhancing the structural strength.

8. The transformer winding structure of claim 6, wherein said each secondary winding pipe includes an installing section extended from another side, and said installing section is coupled to a plurality of second terminals for outputting a converted voltage.

9. The transformer winding structure of claim 1, wherein said each secondary winding pipe further comprises a plurality of partition sections arranged separately from each other.

10. The transformer winding structure of claim 1, wherein the primary coil encircles the primary winding rack but fails to encircle the secondary winding racks.

11. The transformer winding structure of claim 1, wherein each of the at least two secondary winding racks have a coil wound there around in a same direction.

12. The transformer winding structure of claim 1, wherein each of the at least two secondary winding racks extend in a same direction.

13. The transformer winding structure of claim 1, wherein each of the at least two secondary winding racks has a longitudinal axis with the longitudinal axes of the at least two secondary winding racks being parallel and non-coincident.

14. The transformer winding structure of claim 12, wherein the primary winding rack has a longitudinal axis which is perpendicular to the axes of the at least two secondary winding racks.

* * * * *